US012680428B2

(12) United States Patent
Boyd et al.

(10) Patent No.: US 12,680,428 B2
(45) Date of Patent: Jul. 14, 2026

(54) UNIBODY SHIFT ROD PLUNGER

(71) Applicant: Flowco MasterCo LLC, Houston, TX (US)

(72) Inventors: Mitchell A Boyd, Haslet, TX (US); Garrett S. Boyd, Granbury, TX (US)

(73) Assignee: Flowco MasterCo LLC, Houston, TX (US)

( * ) Notice: Subject to any disclaimer, the term of this patent is extended or adjusted under 35 U.S.C. 154(b) by 0 days.

(21) Appl. No.: 19/246,150

(22) Filed: Jun. 23, 2025

(65) Prior Publication Data

US 2025/0314158 A1 Oct. 9, 2025

Related U.S. Application Data

(63) Continuation-in-part of application No. 17/025,322, filed on Sep. 18, 2020, now abandoned.

(60) Provisional application No. 62/902,066, filed on Sep. 18, 2019.

(51) Int. Cl.
*E21B 43/12* (2006.01)
*E21B 34/06* (2006.01)

(52) U.S. Cl.
CPC ..... *E21B 43/121* (2013.01); *E21B 34/06* (2013.01)

(58) Field of Classification Search
CPC ..... E21B 43/12; E21B 43/121; E21B 34/06
See application file for complete search history.

(56) References Cited

U.S. PATENT DOCUMENTS

| | | | |
|---|---|---|---|
| 1,415,788 | A | 5/1922 | Burlin |
| 1,509,386 | A | 9/1924 | Wilson |
| 1,910,616 | A | 5/1933 | Leahy |
| 1,932,992 | A | 10/1933 | Sherman |
| 2,018,204 | A | 10/1935 | Evans |
| 2,175,770 | A | 10/1939 | Dodson |
| 2,215,751 | A | 9/1940 | Coleman |
| 2,301,319 | A | 11/1942 | Peters |
| 2,312,476 | A | 3/1943 | Penick |
| 2,437,429 | A | 3/1948 | Hossfeld |
| 2,509,922 | A | 5/1950 | Hall |

(Continued)

FOREIGN PATENT DOCUMENTS

| | | | |
|---|---|---|---|
| CA | 2428618 | A1 | 11/2004 |
| CA | 2635993 | A1 | 12/2009 |

(Continued)

OTHER PUBLICATIONS

Bal-Seal, Bal Spring™ Canted Coil Springs for Mechanical Applications, product website, 3 pages, © 2015 Bal Seal Engineering, Inc., www.balseal.com/mechanical.

(Continued)

*Primary Examiner* — Yanick A Akaragwe

(74) *Attorney, Agent, or Firm* — Jason P. Mueller; FisherBroyles, LLP

(57) ABSTRACT

A unibody bypass plunger has a unitary one-piece hollow body, a valve cage, a clutch, and a shift rod with a valve located on a lower portion of the shift rod. A fishneck is provided on an upper end of the shift rod. The fishneck may comprise a cylindrical member that is attached to the upper end of the shift rod. Flow ports are provided on both the upper and lower portions of the one-piece hollow body. The flow ports may be configured to receive plugs to block the flow of fluid though the flow ports.

18 Claims, 6 Drawing Sheets

(56) References Cited

U.S. PATENT DOCUMENTS 2,642,002 A 6/1953 Knox
2,661,024 A 12/1953 Knox
2,676,547 A 4/1954 Knox
2,714,855 A 8/1955 Brown
2,762,310 A 9/1956 Eklund
2,785,757 A 3/1957 Middleton
2,878,754 A 3/1959 Mcmurry
2,956,797 A 10/1960 Polhemus
2,962,978 A 12/1960 Reeves
2,970,547 A 2/1961 Mcmurry
3,020,852 A 2/1962 Roach
3,055,306 A 9/1962 Tausch
3,090,315 A 5/1963 Milton
3,127,197 A 3/1964 Kretzschmar
3,146,725 A 9/1964 Harris
3,171,487 A 3/1965 Ault
3,181,470 A 5/1965 Clingman
3,304,874 A 2/1967 Lyles
3,395,759 A 8/1968 Talley, Jr.
3,412,798 A 11/1968 Gregston
3,508,428 A 4/1970 Matson
3,806,106 A 4/1974 Hamel
3,861,471 A 1/1975 Matson
3,944,641 A 3/1976 Lemelson
4,018,248 A 4/1977 Carr
4,030,858 A 6/1977 Coles, Jr.
4,211,279 A 7/1980 Isaacks
4,239,458 A 12/1980 Yeatts
4,440,229 A 4/1984 Burch
4,502,843 A 3/1985 Martin
4,531,891 A 7/1985 Coles, III
4,571,162 A 2/1986 Knox
4,629,004 A 12/1986 Griffin
4,782,896 A 11/1988 Witten
4,896,720 A 1/1990 Derouen
4,932,471 A 6/1990 Tucker
4,951,752 A 8/1990 Coleman
4,995,459 A 2/1991 Mabry
5,218,763 A 6/1993 Marker
5,253,713 A 10/1993 Gregg
5,280,890 A 1/1994 Wydra
5,417,291 A 5/1995 Leising
5,427,504 A 6/1995 Dinning
5,868,384 A 2/1999 Anderson
6,045,335 A 4/2000 Dinning
6,148,923 A 11/2000 Casey
6,176,309 B1 1/2001 Bender
6,200,103 B1 3/2001 Bender
6,209,637 B1 4/2001 Wells
6,234,770 B1 5/2001 Ridley
6,467,541 B1 10/2002 Wells
6,478,087 B2 11/2002 Allen
6,554,580 B1 * 4/2003 Mayfield ..... E21B 43/121 417/59
6,637,510 B2 10/2003 Lee
6,644,399 B2 11/2003 Abbott
6,669,449 B2 12/2003 Giacomino
6,725,916 B2 4/2004 Gray
6,745,839 B1 6/2004 Simpson
6,755,628 B1 6/2004 Howell
6,808,019 B1 10/2004 Mabry
6,846,509 B2 1/2005 Chen
6,848,509 B2 2/2005 Myerley
6,874,577 B2 * 4/2005 Abbott ..... E21B 43/121 166/101
6,907,926 B2 6/2005 Bosley
7,021,387 B2 4/2006 Lee
7,040,401 B1 5/2006 McCannon
7,055,812 B2 6/2006 Balsells
7,121,335 B2 * 10/2006 Townsend ..... E21B 43/13 166/105
7,188,670 B2 3/2007 Amies
7,290,602 B2 11/2007 Victor
7,314,080 B2 1/2008 Giacomino
7,322,417 B2 1/2008 Rytlewski
7,328,748 B2 2/2008 Giacomino
7,383,878 B1 6/2008 Victor
7,438,125 B2 10/2008 Victor
7,475,731 B2 1/2009 Victor
7,513,301 B2 4/2009 Victor
7,523,783 B2 4/2009 Victor
7,819,189 B1 10/2010 Cosby
7,954,545 B2 6/2011 Hearn
8,181,706 B2 5/2012 Tanton
8,286,700 B1 10/2012 Franchini
8,347,954 B2 1/2013 Amies
8,347,955 B1 1/2013 Sewell
8,448,710 B1 5/2013 Stephens
8,464,798 B2 6/2013 Nadkrynechny
8,627,892 B2 1/2014 Nadkrynechny
8,757,267 B2 6/2014 Mitchell
8,863,837 B2 10/2014 Bender
8,893,777 B1 11/2014 Garrett
9,068,443 B2 6/2015 Jefferies
9,109,424 B2 8/2015 Jefferies
9,677,389 B2 6/2017 Boyd
9,683,430 B1 6/2017 Kuykendall
9,689,242 B2 6/2017 Kuykendall
9,790,772 B2 10/2017 Jefferies
9,869,401 B1 * 1/2018 Boyd ..... E21B 43/121
9,951,591 B2 4/2018 Boyd
10,018,015 B2 7/2018 Purkis
10,161,230 B2 12/2018 Roycroft
10,221,849 B2 3/2019 Roycroft
10,273,789 B2 4/2019 Boyd
10,550,674 B2 2/2020 Boyd
10,767,679 B2 9/2020 Balsells
2002/0005284 A1 1/2002 Allen
2003/0155129 A1 8/2003 Gray
2003/0198513 A1 10/2003 Wang
2003/0215337 A1 11/2003 Lee
2004/0017049 A1 1/2004 Fink
2004/0066039 A1 4/2004 Muhammad
2004/0070128 A1 4/2004 Balsells
2004/0129428 A1 7/2004 Kelley
2005/0056416 A1 3/2005 Gray
2005/0230120 A1 10/2005 Victor
2005/0241819 A1 11/2005 Victor
2006/0024928 A1 2/2006 Seebauer
2006/0054329 A1 3/2006 Chisholm
2006/0065390 A1 3/2006 Amies
2006/0113072 A1 6/2006 Lee
2006/0124292 A1 6/2006 Victor
2006/0124294 A1 6/2006 Victor
2006/0185853 A1 8/2006 Bender
2006/0207796 A1 9/2006 Stewart
2006/0214019 A1 9/2006 Ollendick
2006/0249284 A1 11/2006 Victor
2007/0110541 A1 5/2007 Rawlins
2007/0124919 A1 6/2007 Probst
2007/0151738 A1 7/2007 Giacomino
2007/0158061 A1 7/2007 Casey
2008/0029271 A1 2/2008 Bolding
2008/0029721 A1 2/2008 Miyahara
2009/0229835 A1 9/2009 Filippov
2009/0308691 A1 12/2009 Commins
2010/0038071 A1 2/2010 Scott
2011/0073322 A1 * 3/2011 Smith ..... E21B 43/121 166/112
2011/0253382 A1 10/2011 Nadkrynechny
2011/0259438 A1 10/2011 Osborne
2012/0036913 A1 2/2012 Johnson
2012/0204977 A1 8/2012 Lembcke
2012/0304577 A1 12/2012 Reid
2012/0305236 A1 12/2012 Gouthaman
2012/0318524 A1 12/2012 Lea, Jr.
2013/0020091 A1 1/2013 Maerz
2013/0133876 A1 5/2013 Naedler
2014/0090830 A1 4/2014 Maerz
2014/0116714 A1 5/2014 Jefferies
2014/0131107 A1 5/2014 Southard
2014/0131932 A1 5/2014 Balsells
2014/0230940 A1 8/2014 Patton
2015/0000761 A1 1/2015 Jefferies

(56) References Cited

U.S. PATENT DOCUMENTS

| | | | | |
|---|---|---|---|---|
| 2015/0027713 | A1 | 1/2015 | Penisson | |
| 2015/0136389 | A1 | 5/2015 | Bergman | |
| 2015/0167428 | A1 | 6/2015 | Hofman | |
| 2015/0316115 | A1 | 11/2015 | Carter | |
| 2016/0010436 | A1* | 1/2016 | Boyd | E21B 43/121 166/105 |
| 2016/0061012 | A1 | 3/2016 | Zimmerman, Jr. | |
| 2016/0061239 | A1 | 3/2016 | Heaphy | |
| 2016/0108710 | A1 | 4/2016 | Hightower | |
| 2016/0238002 | A1 | 8/2016 | Williams | |
| 2016/0245417 | A1 | 8/2016 | Boyd | |
| 2017/0058651 | A1 | 3/2017 | Damiano | |
| 2017/0107802 | A1 | 4/2017 | Kuykendall | |
| 2017/0107803 | A1 | 4/2017 | Cedillo | |
| 2017/0122084 | A1 | 5/2017 | Brewer | |
| 2017/0268318 | A1 | 9/2017 | Roycroft | |
| 2017/0362917 | A1 | 12/2017 | Esslemont | |
| 2018/0003013 | A1 | 1/2018 | Jackson | |
| 2018/0355695 | A1 | 12/2018 | Holland | |
| 2019/0203570 | A1 | 7/2019 | Boyd | |

FOREIGN PATENT DOCUMENTS

| | | | |
|---|---|---|---|
| CA | 2763511 | A1 | 1/2011 |
| CA | 2791489 | A1 | 12/2012 |
| EP | 2085572 | A2 | 8/2009 |
| GB | 1458906 | A | 12/1976 |

OTHER PUBLICATIONS

Lufkin, Plunger Lift; Bumper Springs website, 2 pages, © 2013 Lufkin Industries, LLC www.lufkin.com.

Weatherford, Plunger Lift Systems brochure, 4 pages; © 2005 Weatherford https://www.weatherford.com/en/products-and-services/production/artificial-lift-systems/plunger-lift/.

Smalley Steel Ring Company; Constant Section Rings (Snap Rings); product brochure (website); 3 pages https://www.smalley.com/retaining-rings/constant-section-rings.

HPAlloys Website printout or Monel K500 (2004) https://www.hpalloy.com/Alloys/descriptions/MONELK_500.aspx.

Lufkin, Lufkin Well Manager Controller for Rod Lift Systems; website, https://www.bhge.com/upstream/production-optimization/artificial-lift/artificial-lift-power-controls-and-automation. 2 pages.

Oilfield Glossary, Definition of "Fishing neck" (Obtained from http://oilgasglossary.com Nov. 2022) (Year: 2012).

Office Action (Final Rejection) dated Mar. 10, 2025 for U.S. Appl. No. 17/025,322 (pp. 1-13).

Office Action (Non-Final Rejection) dated Jun. 2, 2025 for U.S. Appl. No. 17/025,322 (pp. 1-13).

* cited by examiner

UNIBODY SHIFT ROD PLUNGER

CROSS REFERENCE TO RELATED APPLICATIONS

This application is a continuation-in-part of application Ser. No. 17/025,322, filed Sep. 18, 2020, which itself claims the benefit under 35 U.S.C. § 119(e) of U.S. Provisional Patent Application No. 62/902,066 filed on Sep. 18, 2019 and titled UNIBODY SHIFT ROD PLUNGER, both of which are incorporated herein by reference.

BRIEF DESCRIPTION OF THE DRAWINGS

The accompanying drawings form a part of this disclosure and are incorporated into the specification. The drawings illustrate example embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein.

DETAILED DESCRIPTION

This disclosure generally relates to plunger assemblies and gas lift devices that travel through oil, gas, and/or other fluids within well tubing to rejuvenate liquid loading or non-productive wells, and to improvements in the design and construction of components of such gas lift devices.

A newly drilled and completed well typically has sufficient pressure or producing rate within the formation to cause liquids to flow from the formation to the surface without external assistance. Over time, the well's production volume and bottom-hole pressure may decline. When the well pressure or producing rate is no longer sufficient to cause the liquids to flow to the surface, "liquid loading" or a "loaded well" condition may occur. Liquid accumulation in the downhole tubing creates a hydrostatic head that may exceed the well's natural pressure and may cause production to decrease or cease altogether.

For wells that have excess liquids and/or insufficient pressure, it is often desirable to use a plunger lift system as an artificial lifting device that utilizes natural gas energy to unload the liquids after natural well pressures have diminished. These systems may also be known as gas lift plungers, differential pressure operated pistons, bypass plungers, auto-cycling plungers, among other suitable and interchangeable names. A plunger lift system usually requires little to no external energy and is designed to create enough seal around the plunger to efficiently "unload" or lift the liquids to the surface using residual pressure in the well. Accordingly, plunger lift systems may be a cost-effective solution to extend the life of the well.

Figure 1:
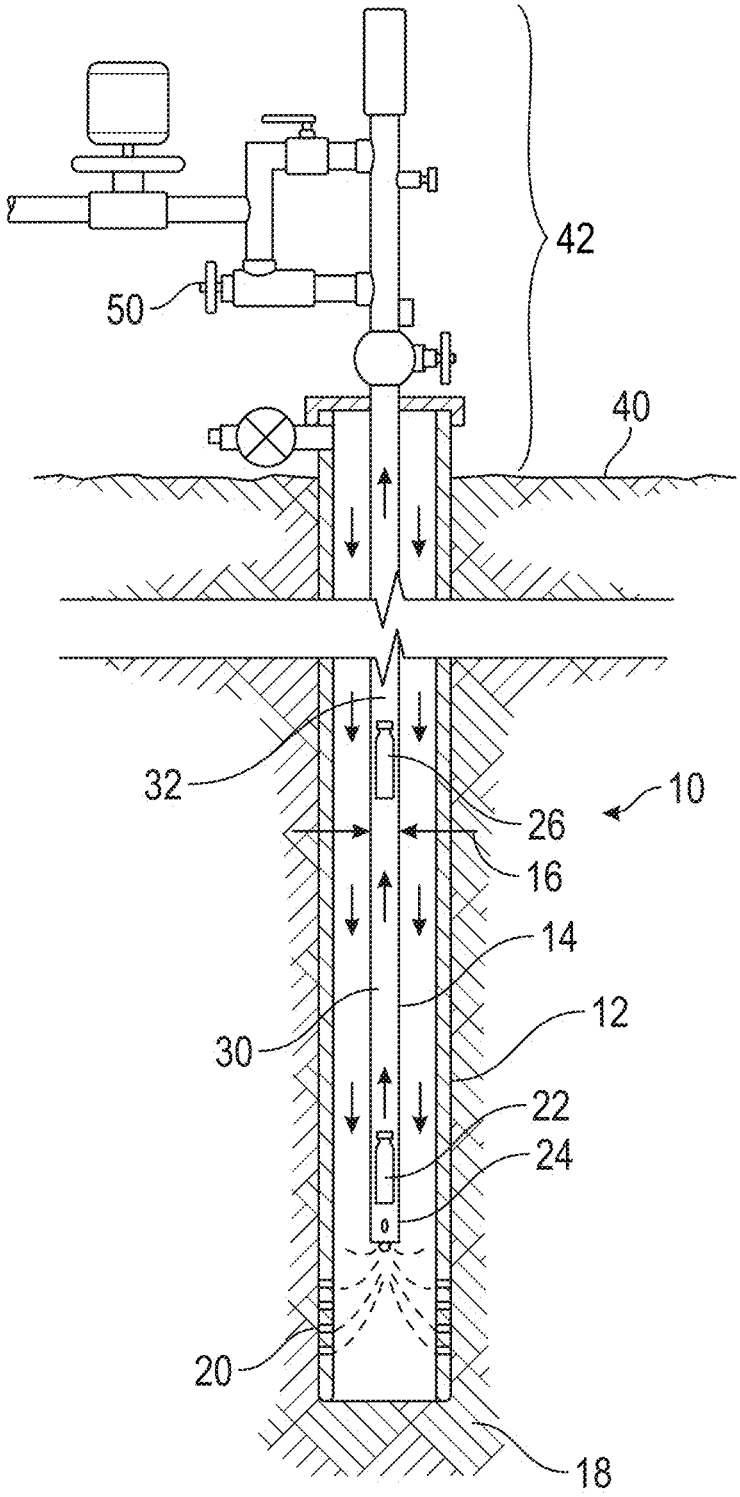
FIG. 1 illustrates an oil and gas well fitted with a plunger lift system that is configured to control production, according to an embodiment of the disclosure.

FIG. 1 illustrates an oil and gas well fitted with a plunger lift system for controlling production, according to some embodiments of the disclosure. In this example, a well 10 is formed by a casing 12 that lines the well 10. A tubing string 14, within casing 12, encloses a well bore 16 through which oil or gas 30 is produced from a formation 18 through perforations 20 in the formation 18. The well 10 includes wellhead apparatus 42 disposed on the surface of the earth 40. Wellhead apparatus 42 is configured to direct production of the well to appropriate receptacles or pipelines (not shown) and to control the plunger lift system, as described in greater detail below. Wellhead apparatus 42 may further include one or more valves 50 that may be configured to allow pressurized gas to be injected into the casing to augment the well's natural pressure.

The plunger lift system includes a plunger or bypass plunger 26 that may be introduced into tubing string 14 and allowed to fall through gas and liquid in tubing string 14. Plunger 26 is stopped by a bumper spring assembly 22 at the bottom of tubing string 14. In this example, bumper spring assembly 22 is configured to rest on a seating nipple 24 (which may also be called a tubing or collar stop). As described in greater detail below, plunger 26 has a valve that may be opened to allow gas and fluids to flow through plunger 26 during descent of plunger 26. Upon hitting bumper spring assembly 22, the valve may be closed so that plunger 26 forms a seal between gas/liquids above and below plunger 26. The natural gas energy in well bore 16 then pushes plunger 26 upward. As such, plunger 26 pushes or lifts a "slug" of fluid 32 ahead of plunger 26. Plunger 26 thereby acts to clear the liquid load from the well as plunger 26 is forced upward by natural gas energy below.

Figure 2A:
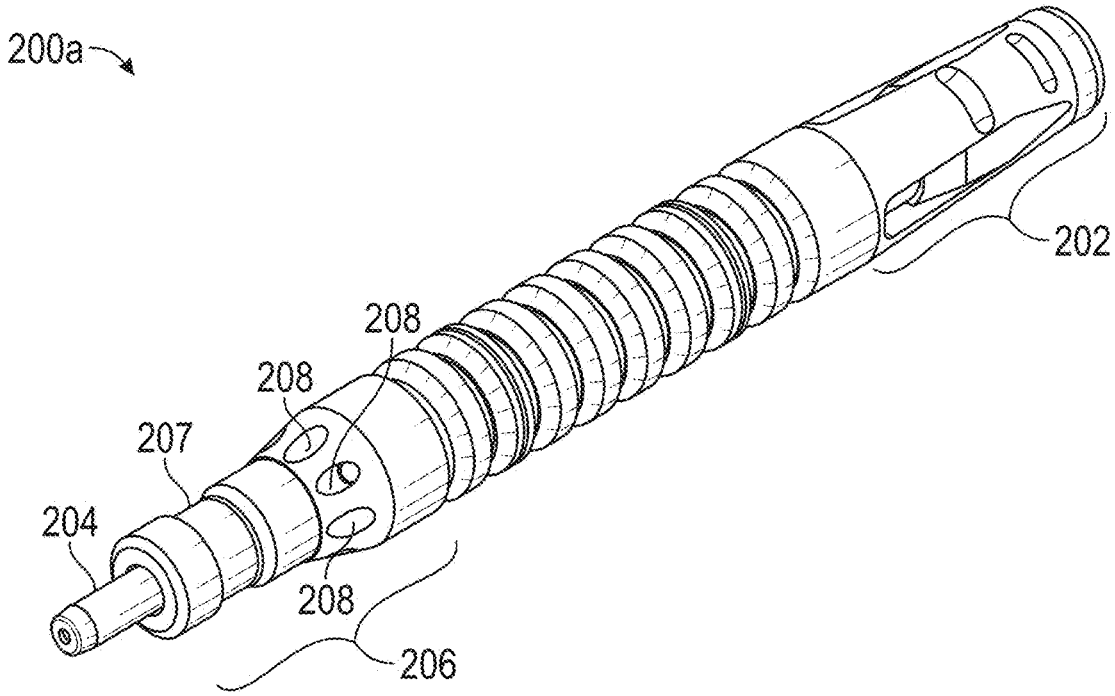
FIG. 2A illustrates a three-dimensional perspective view of a first embodiment of a unibody bypass plunger in a closed configuration, according to an embodiment of the disclosure.
Figure 2B:
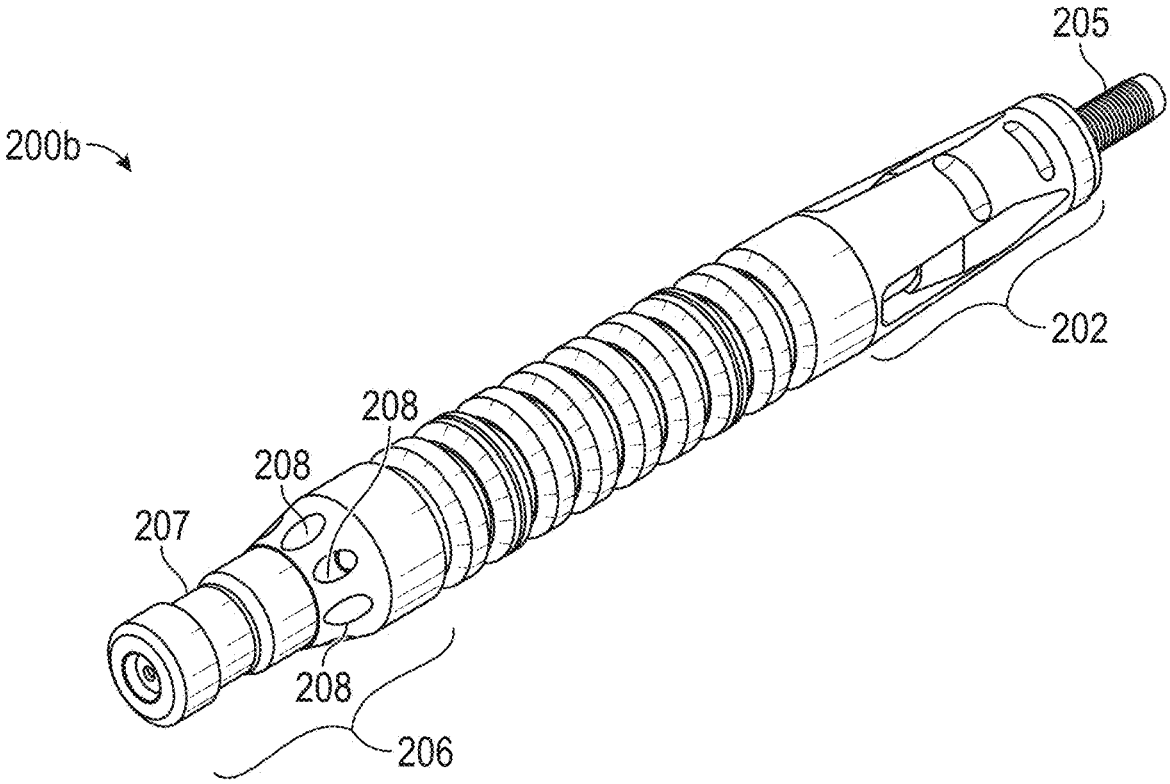
FIG. 2B illustrates a three-dimensional perspective view of the first embodiment of a unibody bypass plunger in an open configuration, according to an embodiment of the disclosure.

FIGS. 2A and 2B illustrate three-dimensional perspective views of a unibody bypass plunger in a closed configuration 200*a* and in an open configuration 200*b*, respectively, according to an embodiment of the disclosure. The unibody bypass plunger of FIGS. 2A and 2B has a unitary or one-piece hollow body-and-valve cage design, a clutch system, crimple fastening structures, and dart and clutch profile that is similar to bypass plungers described, for example, in U.S. Pat. Nos. 9,951,591; 9,963,957; and 10,273,789; the disclosure of each of which is incorporated by reference herein. The terms "one-piece," "unitary," "unibody," "monolithic," and "single-piece" are used interchangeably herein and refer to a structure that is formed of a single piece of material. The single piece of material may be formed, shaped, additively manufactured, machined, cast, molded, or formed through some other suitable process to provide a unibody structure.

The clutch system is provided in a bottom end 202 of the unibody bypass plunger, as described in the above-cited patents. In contrast to previous designs, however, the unibody bypass plunger of FIGS. 2A and 2B includes an integral shift rod that is slidably mounted inside the hollow cylindrical body of the plunger. In many cases, the shift rod is formed as a single-piece and a top end 204 of the shift rod extends out of the top 206 of the plunger body when the plunger is in a closed configuration, as shown in FIG. 2A. A bottom end 205 of the shift rod extends out of the bottom 202 of the plunger body when the plunger is in an open configuration, as shown in FIG. 2B. In this regard, the unibody bypass plunger does not require a separator rod in a lubricator cap to open and close the valve within the plunger.

A top 206 of the unibody bypass plunger provides a further contrast from previous designs. In this regard, the top 206 includes an external fish neck 207, as well as flow ports or slots 208. This is in contrast to prior designs that include an internal fish neck.

The flow ports or slots 208 are configured to be selectively closed by one or more removable or replaceable plugs, as described in greater detail in U.S. patent application Ser. No. 16/294,660, the disclosure of which is incorporated by reference herein. The terms "ports" and "slots" refer to an opening that provides a passageway through the wall of the body of the plunger The terms ports or slots may be used interchangeably herein. A fall speed of the unibody bypass plunger may be adjusted by changing the number of ports or slots 208 that are closed with plugs. The greatest fall speed is obtained with all ports 208 open. The fall speed can be selectively decreased by closing off additional ports 208 with plugs.

Figure 3A:
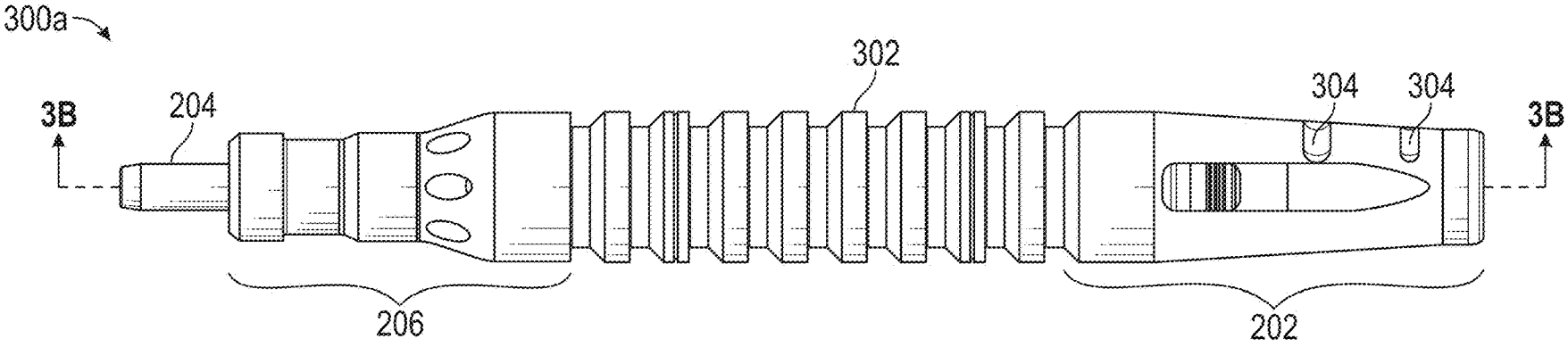
FIG. 3A illustrates a side view of the first embodiment of the unibody bypass plunger of FIGS. 2A and 2B in the closed configuration.

FIG. 3A illustrates a side view 300*a* of the unibody bypass plunger of FIG. 2A, according to some embodiments of the disclosure. The unibody bypass plunger includes the unitary or one-piece hollow body 302, as described in greater detail in the above-cited patents. The clutch system may be held in place using crimple features 304 as shown in FIG. 3A and described in greater detail in the above-cited patents. FIG. 3A also defines a cross-section direction 3B-3B defining the cross-sectional view of FIG. 3B.

Figure 3B:
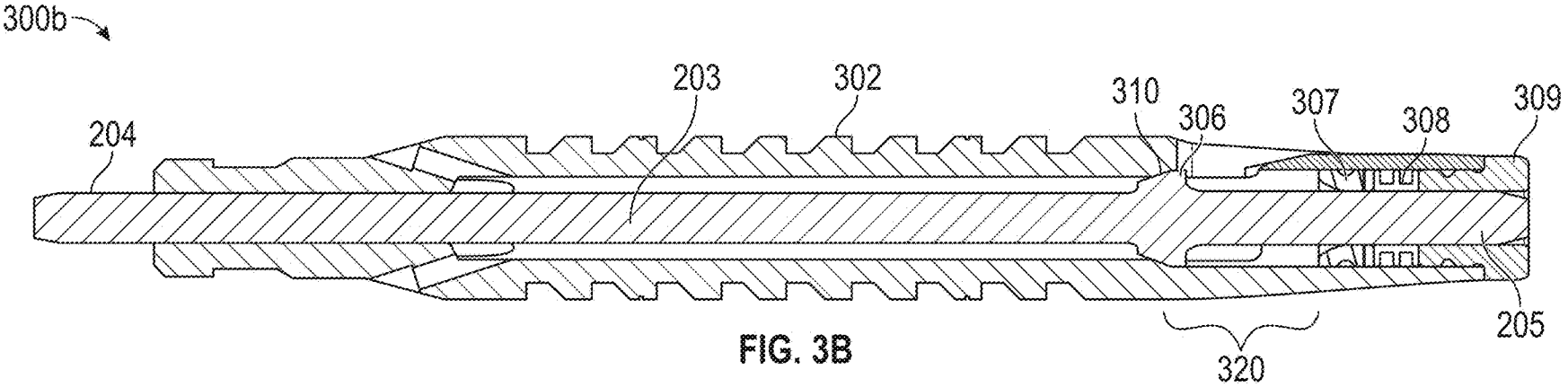
FIG. 3B illustrates a cross-sectional view of the first embodiment of the unibody bypass plunger of FIG. 3A in the closed configuration.
Figure 4A:
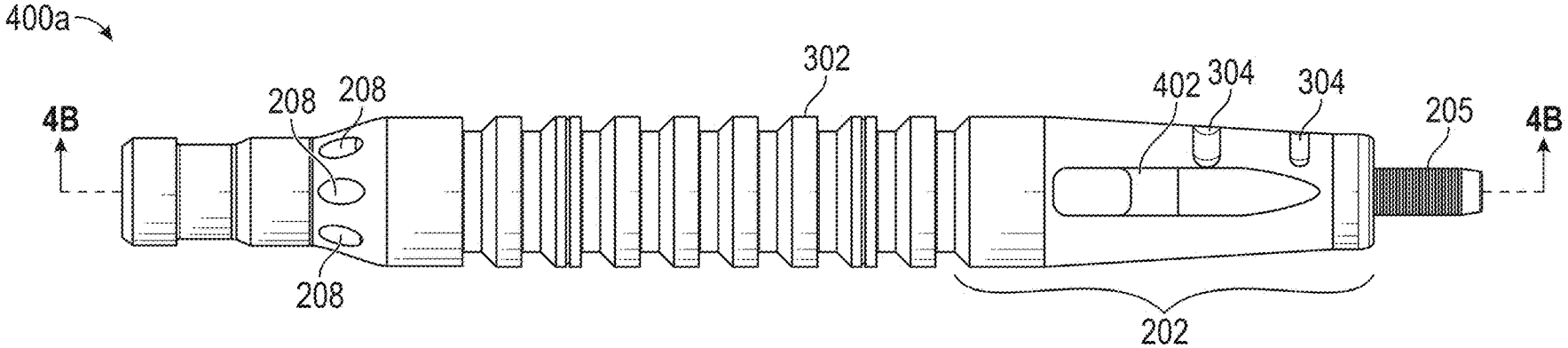
FIG. 4A illustrates a side view of the first embodiment of the unibody bypass plunger of FIGS. 2A and 2B in the open configuration.
Figure 4B:
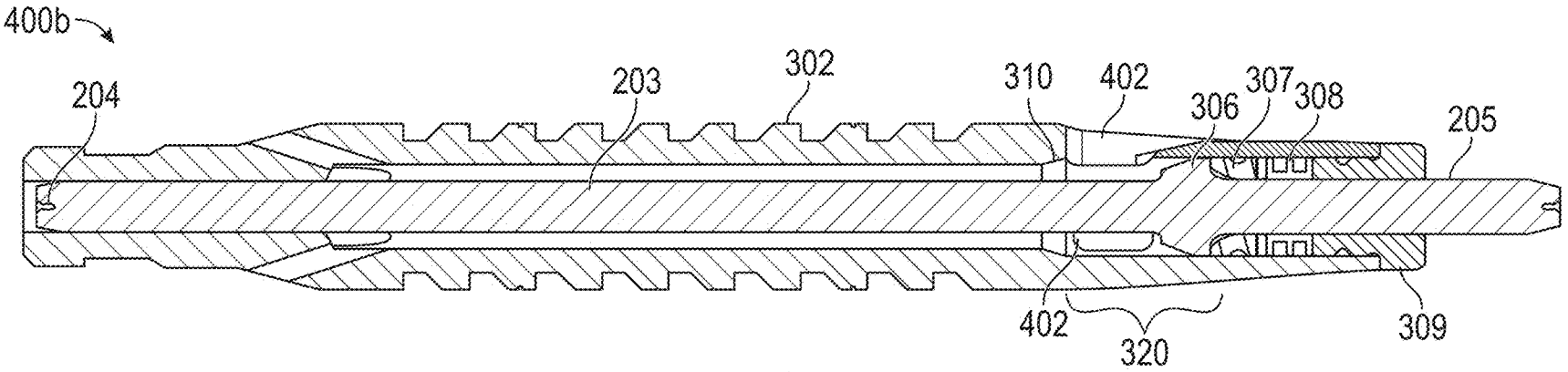
FIG. 4B illustrates a cross-sectional view of the first embodiment of the unibody bypass plunger of FIG. 4A in the open configuration.

FIG. 3B illustrates a cross-sectional view 300*b* of the unibody bypass plunger of FIG. 3A, according to an embodiment of the disclosure. As shown, the shift rod 203 is an integral component of the unibody bypass plunger and extends along a length of the plunger body 302. The shift rod 203 may be formed as a single piece. Further, the shift rod 203 is configured to be longer than the length of the plunger body 302 to thereby extend for a certain distance outside of either the top end 206 of the plunger body 302 or the bottom end 202 of the plunger body 302. The top end 204 of the shift rod 203 extends out of the top 206 of the plunger body 302 in a closed configuration, as shown in FIGS. 2A 3A, and 3B. The bottom end 205 of the shift rod 203 extends out of the bottom 202 of the plunger body 302 in an open configuration, as shown in FIGS. 2B, 4A, and 4B.

The shift rod 203 may be configured to include flats or other features (not shown) to provide an increased bypass flow area between the exterior of the shift rod 203 and the interior of the hollow plunger body 302. The shift rod 203 may further include an increased diameter portion at one or more locations along the length of the shift rod 203 to increase rigidity.

A clutch system 308 is mounted inside the bottom end 202 of the plunger body 302. The clutch system 308 surrounds the lower end of the shift rod 203 and is configured to apply frictional pressure to the exterior surface of the shift rod 203 to hold the shift rod 203 in the open or closed positions, as described in greater detail in U.S. Pat. No. 9,963,957 (cited above). The clutch system 308 can be positioned between a partition nut 307 and an end cap 309. Both the partition nut 307 and the end cap 390 may have external threads that are screwed into internal threads of the bottom end of the hollow plunger body 302. The positions of the partition nut 307 and the end cap 309 on the hollow plunger body 302 can be fixed by crimples 304, which are portions of the cylindrical wall of the hollow plunger body 302 that are deformed inward to bear against the exterior threads of the partition nut 307 and end cap 309 to prevent them from rotating relative to the plunger body 302, and thereby moving position on the hollow plunger body 302.

A valve 306 is formed on an interim or middle portion of the shift rod 203. The valve 306 is configured to bear against and form a seal with a valve seat 310 provided on an interior surface of the hollow plunger body 302. When the plunger is in the closed configuration, the shift rod is in a closed position, as depicted in FIGS. 3A and 3B, where the valve 306 on the shift rod 203 forms a seal with the valve seat 310 on the hollow plunger body. This prevents fluids from flowing though the interior of the hollow plunger body 302.

The shift rod 203 is moved from the closed position depicted in FIGS. 3A and 3B to an open position, as depicted in FIGS. 4A and 4B by causing the shift rod to translate downward with respect to the hollow plunger body 302. This typically happens when the plunger reaches the top of a well and is received in a lubricator. The upward movement of the plunger into the lubricator causes the top end 204 of the shift rod 203 to impact an anvil, which causes the shift rod 203 to translate downward within the hollow plunger body 302 to the open position depicted in FIGS. 4A and 4B.

When the shift rod 203 is in the open position, the valve 306 on the shift rod 203 is spaced apart from the valve seat 310. This allows fluid to flow into lower flow ports 402 in the hollow plunger body 302, throught the interior of the hollow plunger body 302 and out the upper flow ports 208 at the upper end 206 of the hollow plunger body 302. This allows the plunger to descend back into the wellbore.

When the plunger reaches the bottom of the wellbore, the bottom end 205 of the shift rod 203, which is extending out from the bottom end 202 of the hollow plunger body 302 will strike an element at the bottom of the well, which causes the shift rod 203 to translate upward relative to the hollow plunger body 302, causing the shift rod to return to the closed position depicted in FIGS. 3A and 3B.

In some cases, the valve seat 310 is formed within a boundary zone near the bottom end 202 of the hollow plunger body 302. The boundary zone may include the internal valve seat 310 conformably shaped to a profile of the valve 306 portion of the shift rod 203. The valve seat 310 has a portion that is angled relative to a longitudinal axis of the bypass plunger. The valve seat 310 may be formed in the bottom end 202 of the bypass plunger at a location that has a constant outside diameter.

According to some embodiments, the boundary zone has a uniform diameter defining a first diameter and an outside diameter of the bottom end is tapered with a uniform taper angle from a first end of the monolithic one-piece tubular plunger unit to the first diameter of the boundary zone.

In alternate embodiments, a greater or fewer number of slots 402 may be provided on the lower end 202 of the hollow plunger body 302. Alternatively, the slots 402 may be replaced with ports or other apertures, such as ports 208 provided in the top 206 of the unibody bypass plunger. Similarly, ports 208 may be replaced with slots or other types of apertures.

The external texture of body 302 is configured as a turbulent seal style. In further embodiments, the external texture may be padded, diamond cut, rifled, or even be a brush style plunger. Such alternate textures are described in greater detail in U.S. patent application Ser. No. 16/361,651, and in U.S. Provisional Patent Application Nos. 62/876,155 and 62/773,749, the disclosure of each of which is incorporated by reference herein.

Figure 5A:
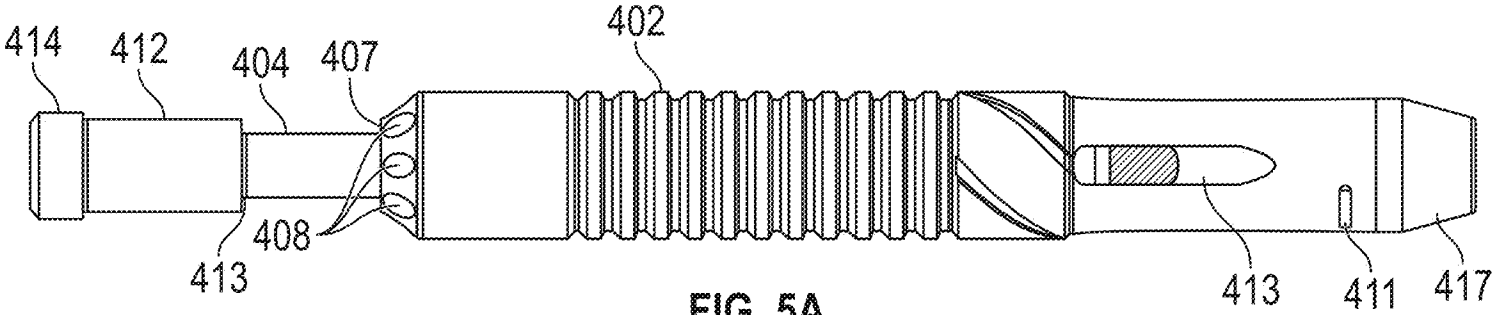
FIG. 5A illustrates a side view of a second embodiment of the unibody bypass plunger of in a closed configuration.
Figure 5B:
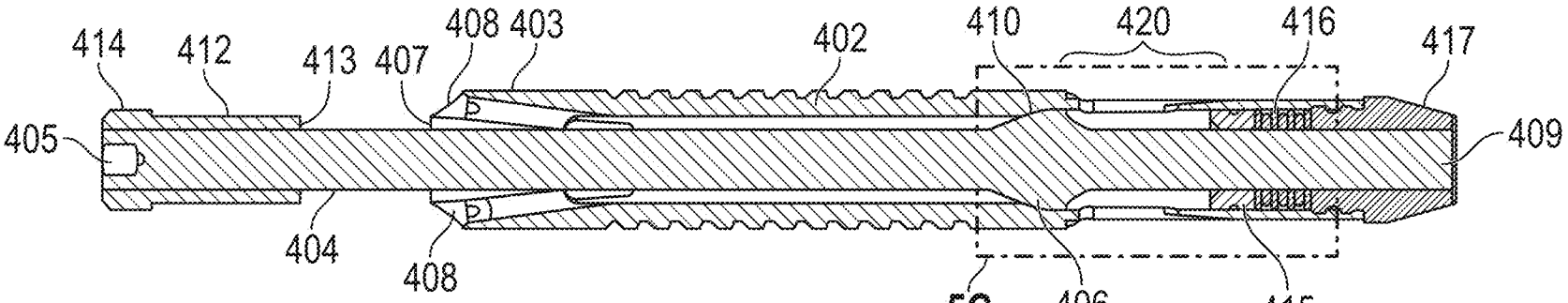
FIG. 5B illustrates a cross-sectional view of the second embodiment of the unibody bypass plunger of FIG. 5A in the closed configuration.
Figure 5D:
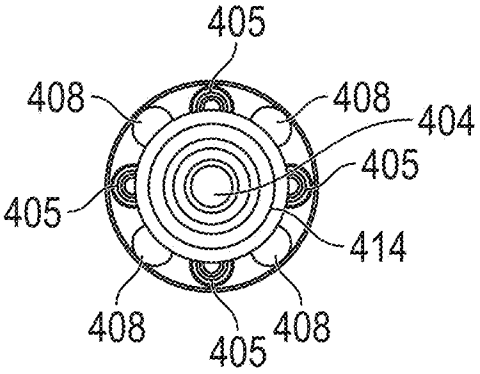
FIG. 5D is an end view of the second embodiment of the unibody bypass plunger.
Figure 5C:
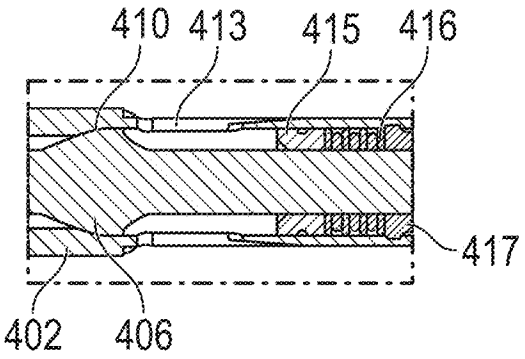
FIG. 5C is an enlarged view of the valve cage portion of the second embodiment of the unibody bypass plunger of FIG. 5A in the closed configuration.
Figure 6A:
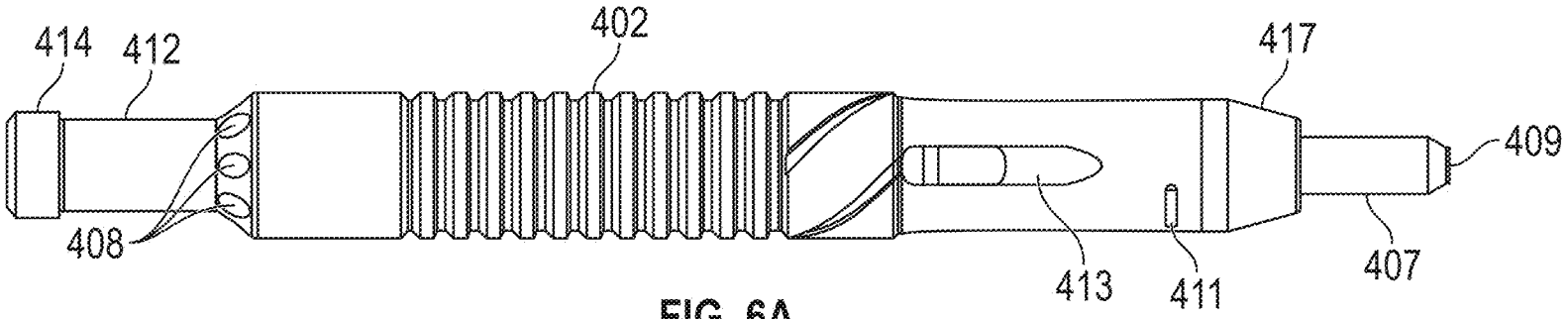
FIG. 6A illustrates a side view of the second embodiment of the unibody bypass plunger in the open configuration.
Figure 6B:
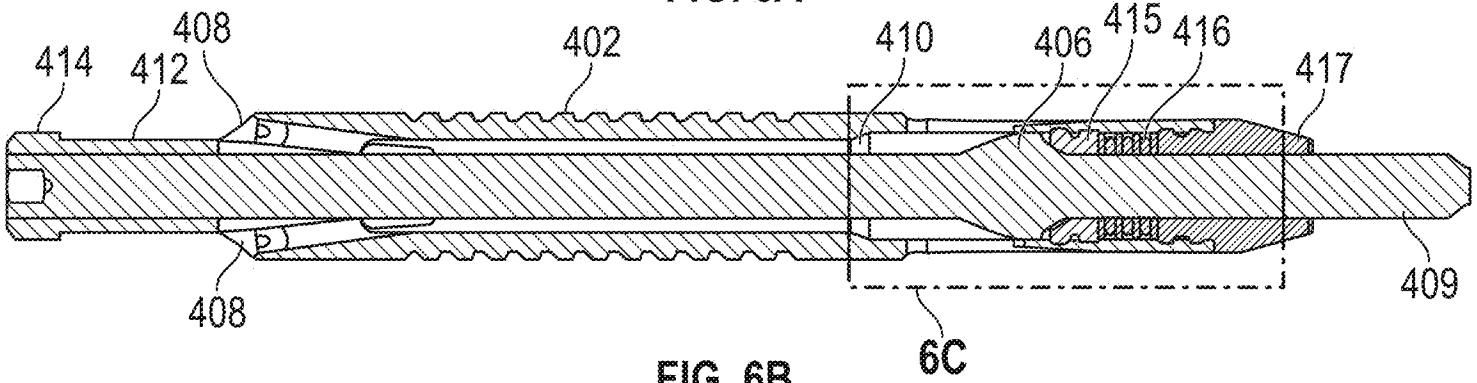
FIG. 6B illustrates a cross-sectional view of the second embodiment of the unibody bypass plunger of FIG. 6A in the open configuration.
Figure 6C:
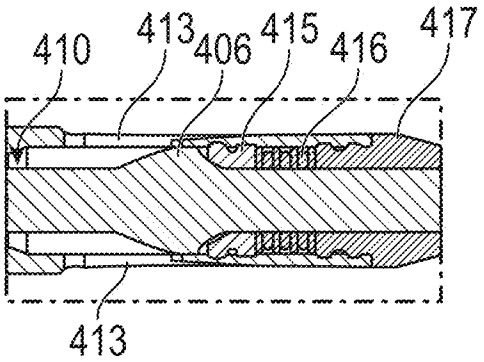
FIG. 6C is an enlarged view of the valve cage portion of the second embodiment of the unibody bypass plunger of FIG. 6A in the open configuration.

FIGS. 5A-6C illustrate a second embodiment of a shift rod bypass plunger. FIGS. 5A-5D illustrate the plunger when the shift rod is in the closed position, and FIGS. 6A-6C illustrate the plunger when the shift rod is in the open position.

In this embodiment, a unitary cylindrical hollow body 402 includes a plurality of upper flow apertures 408 that extend from an interior of the hollow body 402 to an exterior surface of the hollow body 402 located at or adjacent the top 403 of the hollow body. The upper flow apertures 408 have a central longitudinal axis that extends at a shallow angle with respect to a central longitudinal axis of the plunger body 402. The angle formed between the central longitudinal axis of the upper flow apertures 408 and a central longitudinal axis of the hollow body 402 can be between 5 degrees and 15 degrees.

The entrance to the upper flow apertures 408 formed on the outer surface of the hollow body 402 are formed on an angled portion of the upper end 403 of the hollow body 402.

A plurality of lower flow apertures 413 are formed in a valve cage portion 420 located at a lower end of the hollow body 402.

The shift rod 404 that is slidably mounted in the hollow body 402 includes a valve portion 406 with an angled surface which engages a valve seat 410 formed on an interior surface of the hollow body 402. When the shift rod 404 is in the closed position, as illustrated in FIGS. 5A-5D, the valve 406 on the shift rod 404 engages the valve seat 410 on the hollow body 402 to prevent fluids from flowing through the interior of the hollow body 402.

To assembly the plunger, it is necessary to insert the shift rod 404 into the bottom of the hollow body 402 until the top of the shift rod 404 protrudes from the top 403 of the hollow body 402. This is necessary because the valve 406 on the shift rod 404 has an outer diameter that is larger than the inner diameter of the valve seat 410.

It is desirable for the fishneck to have an outer diameter that is larger than the inner diameter of the valve seat 410. This means that an additional element forming the fishneck must be attached to the upper end of the shift rod 404 after the shift rod 404 has been inserted into the interior of the hollow body 402. In this embodiment, a cylindrical element is attached to the upper end of the shift rod 404 to form the fishneck 412. The fishneck 412 includes an enlarged end portion 414 which is used to grasp the plunger to remove it from a wellbore.

The fishneck 412 can be attached to the upper end of the shift rod 404 via any suitable means. In some embodiments, an aperture 405 is machined into the upper end of the shift rod 404. The fishneck is placed over the upper end of the shift rod 404 and a swaging operation is then performed to expand the outer diameter of the end of the shift rod 404 so that it engages and forms an interference fit with the interior bore of the fishneck 412. The swaging operation ensures that the fishneck is securely attached to the upper end of the shift rod 404.

In alternate embodiments, the fishneck could be attached to the upper end of the shift rod 404 via alternate fixation means. Thus, the description of a swaging operation to attach the fishneck 412 to the shift rod 404 should in no way be considered limiting.

The lower end of the hollow body 402 houses a clutch assembly 416. In the embodiment illustrated in FIGS. 5A-6C, the clutch assembly 416 is a split-bobbin assembly which includes three circular coil springs mounted in three corresponding grooves around the exterior of the split bobbin. In alternate embodiments, the clutch assembly could have a variety of different configurations. For example, the clutch assembly could include one or more coil springs that directly bear against the exterior surface of the lower end 409 of the shift rod 404. Also, the clutch assembly could use elements other than coil springs to apply a frictional force against the exterior surface of the lower end 409 of the shift rod 404 to constrain or impede movement of the shift rod 404. For example, the clutch assembly could include an expandable ring of synthetic material that can be mounted over the exterior surface of the lower end 409 of the shift rod 404.

The clutch assembly 416 is positioned between a partition nut 415 and an end cap 417. The partition nut 415 and the end cap 417 both include exterior threads which are screwed onto interior threads formed in the lower portion of the interior of the hollow body 402. Crimples portions 411 can be formed in the wall of the hollow body 402 to help secure either the partition nut 415 and/or the end cap 417 to the cylindrical hollow body 402. Each crimple 411 comprises a deformed portion of the cylindrical wall of the hollow body 402 which is pressed inward against the exterior threads of the partition nut 415 and/or the end cap 417, which prevents the partition nut 415 and the end cap 417 from rotating with respect to the hollow body 402, thereby securing the partition nut 415 and end cap 417 to the hollow body 402.

The plunger would have the shift rod 404 in the closed position illustrated in FIGS. 5A-5C as the plunger travels upward within a wellbore. When the plunger arrives at the top of the wellbore, the top end of the shift rod 404, which could include the fishneck 412, would impact an anvil within the lubricator mounted at the top of the well bore. This impact would cause the shift rod 404 to translate downward with respect to the hollow body 402 so that the shift rod moves into the open position illustrated in FIGS. 6A-6C.

Downward movement of the shift rod 408 relative to the hollow body 402 ends when a lower portion 413 of the fishneck 412 impacts the upper end 407 of the hollow body 402. Interference between the lower edge 413 of the fishneck 412 and the upper end 407 of the hollow body 402 stops downward movement of the shift rod 404 and establishes the position of the shift rod in the open position. The clutch assembly 416 which surrounds and grasps the lower portion 409 of the shift rod 404 then holds the shift rod 404 in the open position illustrated in FIGS. 6A-6C.

When the shift rod 404 is in the open position, the valve 406 on the shift rod is spaced apart from the valve seat 410 on the inner surface of the hollow body 402. This makes it possible for fluid to travel into the interior of the hollow body 402 via the lower flow apertures 413. The fluid can then flow up through the interior of the hollow body 402 and exit through the upper flow apertures 408. This allows the plunger to descend back to the bottom of the wellbore.

In some embodiments, ridges or striations or threads can be formed on the exterior surface of the bottom portion of the shift rod 404. The textured surface 407 (see FIG. 6A) of the lower portion 409 of the shift rod 404 increases the friction between lower portion 407 of the shift rod 404 in the interior surface of the clutch assembly 416 to enhance the ability of the clutch assembly 416 to hold the shift rod 404 at the closed and opened positions.

FIG. 5D illustrates a top view of the bypass plunger illustrated in FIGS. 5A-5C. As shown therein, the upper flow apertures 408 are spaced evenly around the circumference of the hollow body 402. In the depiction provided in FIG. 5D, four plugs 405 are inserted into four of the upper flow apertures 408 to seal off the plugged apertures 408. This decreases the amount of fluid flow which can pass through the interior of the hollow body 402, which slows the descent speed of the plunger through the wellbore relative to a condition where all of the upper flow apertures 408 are open. One can adjust the descent speed by removing plugs 405 from the upper flow apertures 408 to increase the descent speed, or by inserting additional plugs 405 into the upper flow apertures 408 to decrease the descent speed.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

While this disclosure is described with reference to various embodiments, it is noted that such embodiments are illustrative and that the scope of the disclosure is not limited to them. Those of ordinary skill in the art may recognize that many further combinations and permutations of the disclosed features are possible. As such, various modifications may be made to the disclosure without departing from the scope or spirit thereof. In addition or in the alternative, other embodiments of the disclosure may be apparent from consideration of the specification and annexed drawings, and practice of the disclosure as presented herein. The examples put forward in the specification and annexed drawings are illustrative and not restrictive. Although specific terms are employed herein, they are used in a generic and descriptive sense only and not for purposes of limitation.

What is claimed is:

1. A bypass plunger comprising:

a monolithic hollow body having a length that extends between a top end surface and a bottom end, the top end surface having a radially inner annular flat surface and a radially outer conical surface angling from the inner flat surface to a sidewall of the monolithic hollow body;

a plurality of upper flow apertures, each of the upper flow apertures extending through the monolithic hollow body from an interior of the monolithic hollow body to an opening on the radially outer conical surface;

a valve cage located adjacent the bottom end of the monolithic hollow body, the valve cage including:

a valve seat formed on an interior surface of the monolithic hollow body, and a plurality of lower flow apertures, each of the lower flow apertures extending through the monolithic hollow body from an interior of the valve cage to an exterior of the monolithic hollow body; and a monolithic shift rod that is slidably mounted inside the monolithic hollow body so that it can translate between open and closed positions, the shift rod having a length that is greater than the length of the monolithic hollow body and including a valve, wherein the valve is located on a portion of the shift rod that always remains inside the valve cage as the shift rod translates between the open position and the closed position, and wherein when the shift rod is in the closed position, the valve on the shift rod seals against the valve seat to prevent fluid from flowing through the interior of the monolithic hollow body.

2. The bypass plunger of claim 1, further comprising a fishneck located on a top end of the shift rod.

3. The bypass plunger of claim 2, wherein when an upper portion of the shift rod translates downward into the monolithic hollow body as the shift rod translates between the closed and open positions, a bottom of the fishneck bears against the top end surface of the monolithic hollow body to halt downward movement of the shift rod within the monolithic hollow body.

4. The bypass plunger of claim 2, wherein interference between the fishneck and the top end surface of the monolithic hollow body determines the open position of the shift rod.

5. The bypass plunger of claim 2, wherein the fishneck comprises a hollow cylindrical body that is attached to the top end of the shift rod.

6. The bypass plunger of claim 5, wherein the fishneck is attached to the top end of the shift rod via a swaging process in which an external diameter of the top end of the shift rod is enlarged so that it bears against and forms an interference fit with an interior of the hollow cylindrical body of the fishneck.

7. The bypass plunger of claim 1, wherein a central longitudinal axis of each upper flow aperture forms an angle of between approximately 5° and approximately 15° with respect to a central longitudinal axis of the monolithic hollow body.

8. The bypass plunger of claim 1, further comprising a clutch mounted adjacent the bottom end of the monolithic hollow body, wherein the clutch surrounds a lower end of the shift rod, and wherein the clutch constrains movement of the shift rod relative to monolithic hollow body.

9. The bypass plunger of claim 8, wherein the clutch is configured to hold the shift rod at the open and closed positions as the bypass plunger moves within a wellbore.

10. The bypass plunger of claim 8, further comprising:

a partition nut that is mounted inside the monolithic hollow body below the valve cage; and an end cap that is mounted to the bottom end of the monolithic hollow body, wherein the clutch is positioned between the partition nut and the end cap.

11. A bypass plunger, comprising:

a monolithic hollow body having a length that extends between a top end surface and a bottom end, the top end surface having a radially inner flat annular surface and a radially outer conical surface angling from the inner flat surface to a sidewall of the monolithic hollow body;

a plurality of upper flow apertures, each of the upper flow apertures extending from an interior of the monolithic hollow body to an opening on the radially outer conical surface;

a valve cage located adjacent the bottom end of the monolithic hollow body, the valve cage including:

a valve seat formed on an interior surface of the monolithic hollow body, and a plurality of lower flow apertures, each of the lower flow apertures extending through the monolithic hollow body from an interior of the valve cage to an exterior of the monolithic hollow body; and a monolithic shift rod that is slidably mounted inside the monolithic hollow body, the shift rod having a length that is greater than the length of the monolithic hollow body, the shift rod comprising:

a fishneck located at an upper end of the shift rod; and a valve located on an interim portion of the shift rod, wherein the shift rod can translate relative to the monolithic hollow body between an open position in which the valve is spaced apart from the valve seat and a closed position in which the valve seals against the valve seat to prevent fluid from flowing through the interior of the monolithic hollow body;

wherein interference between the fishneck and the top end of the monolithic hollow body limits downward translation of the shift rod relative to the monolithic hollow body, and wherein seating of the valve against the valve seat limits upward translation of the shift rod relative to the hollow plunger body.

12. The bypass plunger of claim 11, wherein a central longitudinal axis of each upper flow aperture forms an angle of between approximately 5° and approximately 15° with respect to a central longitudinal axis of the monolithic hollow plunger body.

13. The bypass plunger of claim 11, wherein each of the upper flow apertures opens to the outer conical surface of the monolithic hollow body that is not blocked by the fishneck when the shift rod is in the open position.

14. The bypass plunger of claim 11, wherein the fishneck comprises a hollow cylindrical body that is attached to the upper end of the shift rod.

15. The bypass plunger of claim 14, wherein the fishneck is attached to the upper end of the shift rod via a swaging process in which an external diameter of the upper end of the shift rod is enlarged so that it bears against and forms an interference fit with an interior of the hollow cylindrical body of the fishneck.

16. The bypass plunger of claim 11, further comprising a clutch mounted adjacent the bottom end of the monolithic hollow body, wherein the clutch surrounds a lower end of the shift rod, and wherein the clutch constrains movement of the shift rod relative to monolithic hollow body.

17. The bypass plunger of claim 16, further comprising:

a partition nut that is mounted inside the monolithic hollow body below the valve cage; and an end cap that is mounted to the bottom end of the monolithic hollow body, wherein the clutch is positioned between the partition nut and the end cap.

18. The bypass plunger of claim 11, wherein the valve is located on a portion of the shift rod that always remains inside the valve cage as the shift rod translates between the open position and the closed position.

* * * * *